US010809641B1

(12) United States Patent
Able et al.

(10) Patent No.: US 10,809,641 B1
(45) Date of Patent: Oct. 20, 2020

(54) REDUCING WASTE TONER WITH ELECTROPHOTOGRAPHIC VOLTAGE CONTROL IN IMAGING DEVICES

(71) Applicant: LEXMARK INTERNATIONAL, INC., Lexington, KY (US)

(72) Inventors: Douglas Anthony Able, Shelbyville, KY (US); Andrew Pryse Dale, Lexington, KY (US); Jared Kuohui Lin, Lexington, KY (US); Matthew David Heid, Louisville, KY (US); Christopher David Strack, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/518,215

(22) Filed: Jul. 22, 2019

(51) Int. Cl.
*G03G 15/02* (2006.01)
*G03G 15/16* (2006.01)
*G03G 15/06* (2006.01)

(52) U.S. Cl.
CPC ..... *G03G 15/0216* (2013.01); *G03G 15/0283* (2013.01); *G03G 15/065* (2013.01); *G03G 15/1675* (2013.01); *G03G 2215/00084* (2013.01)

(58) Field of Classification Search
CPC ..... G03G 15/065; G03G 15/0216; G03G 15/0283; G03G 15/1675; G03G 2215/00084
See application file for complete search history.

(56) References Cited

U.S. PATENT DOCUMENTS 5,426,488 A * 6/1995 Hayakawa ..... G03G 15/0216 361/225
5,799,225 A * 8/1998 Abe ..... G03G 15/167 399/303
6,327,445 B1 * 12/2001 Honda ..... G03G 15/1675 399/45
6,336,007 B1 * 1/2002 Sugisaki ..... B41J 29/38 399/11
2003/0175040 A1 * 9/2003 Ogata ..... G03G 15/1675 399/55
2004/0042813 A1 3/2004 Takai
2010/0080587 A1 * 4/2010 Booth ..... G03G 15/0266 399/44
2013/0136468 A1 * 5/2013 Shimizu ..... G03G 15/0189 399/44

(Continued)

*Primary Examiner* — Ryan D Walsh

(57) ABSTRACT

An imaging device includes a photoconductive drum charged by a charge roll and opposed by developer roll. The developer roll adds toner to the drum to develop a latent image on the drum for transfer to media or an intermediate transfer member at a transfer roll. One or more high voltage power supplies communicate with a controller to set voltages on the rolls. During times of non-imaging, but rotation of the drum, the charge roll charges the drum to less than a Paschen breakdown voltage of the drum. A voltage of the transfer roll is determined that corresponds to a temperature and relative humidity of an operating environment of the imaging device and the developer roll is charged based thereon. The charge of the transfer roll is set close to the charge of the drum, but higher in magnitude. A laser may also discharge the drum.

20 Claims, 1 Drawing Sheet

(56) References Cited

U.S. PATENT DOCUMENTS

| | | | | |
|---|---|---|---|---|
| 2013/0177328 | A1* | 7/2013 | Fukuda | G03G 15/0266 399/43 |
| 2014/0056604 | A1* | 2/2014 | Hayakawa | G03G 15/1675 399/44 |
| 2014/0356005 | A1* | 12/2014 | Sakamoto | H02M 3/33546 399/44 |
| 2017/0308008 | A1* | 10/2017 | Aiba | G03G 15/1665 |
| 2018/0113397 | A1 | 4/2018 | Ozeki | |
| 2018/0253051 | A1* | 9/2018 | Nakai | G03G 21/20 |

* cited by examiner

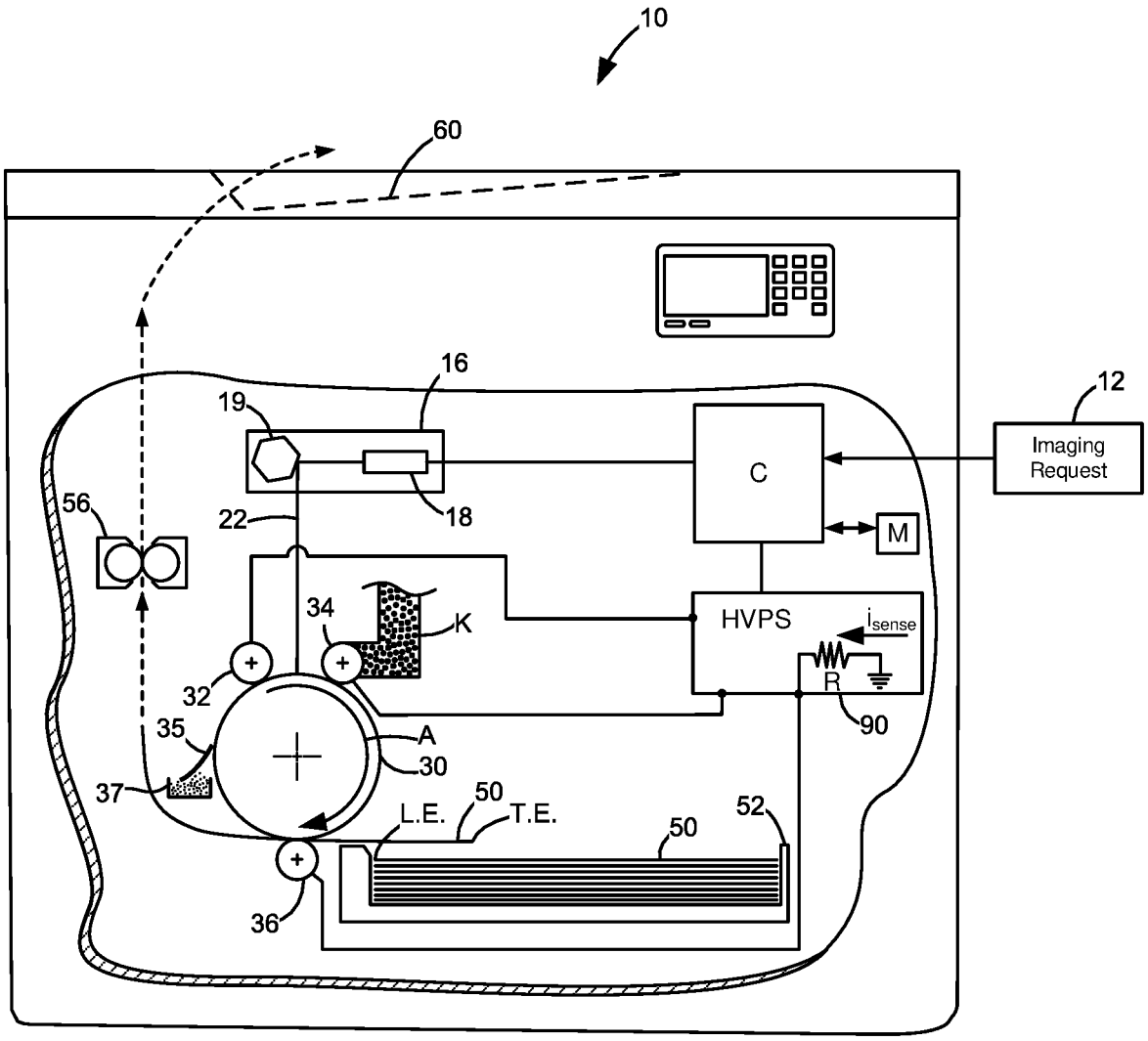
10
60
16
19
12
Imaging Request
C
18
56
22
M
34
K
HVPS
$i_{sense}$
R
32
90
35
A
30
37
50
L.E.
T.E.
52
50
36

REDUCING WASTE TONER WITH ELECTROPHOTOGRAPHIC VOLTAGE CONTROL IN IMAGING DEVICES

The present disclosure relates to the electrophotographic (EP) process in imaging devices, such as printers, copiers, all-in-ones, multi-function devices, etc. It relates further to controlling voltages of the EP process to reduce waste toner.

BACKGROUND

The EP process includes a laser discharging a charged photoconductive (PC) drum to create a latent image that becomes toned with one or more toners (e.g., black, cyan, magenta, yellow). A voltage difference between the drum and an opposed transfer roll transfers the image to a media sheet or to an intermediate transfer member (ITM) for subsequent transfer to a media sheet. A corona or charge roll sets the charge on the PC drum and a developer roll introduces the toner to the latent image. A controller coordinates with one or more high voltage power supplies to provide power to the laser and to set relevant charges on the rolls.

However, hot temperature and high humidity operating environments typically cause the generation of more waste toner compared to cooler temperatures and dryer conditions. More waste fills up waste reservoirs faster which can lead to fewer pages available for imaging and less reliable toner cartridges, such as occurs with toner leakage. Attempts to control this include mechanically separating the developer roll and toner from the drum so that, while the drum rotates, toner cannot attract to the drum, but such increases design complexity and adds hardware cost. Still other attempts seek to shorten the rotations of the drum during non-imaging events, such as before and after imaging jobs. Still others have utilized AC power solutions, but such does not work with DC power supplies. The inventors have identified a need in the art to economically and simply overcome these and other problems.

SUMMARY

The embodiments described herein relate to methods and apparatus that minimize the accumulation of waste toner under relatively hot and humid conditions in which the imaging device operates. In one design, an imaging device includes a photoconductive drum charged by a charge roll and opposed by developer roll. The developer roll adds toner to the drum to develop a latent image on the drum for transfer to media or an intermediate transfer member at a transfer roll. One or more high voltage power supplies communicate with a controller to set voltages on the rolls. During times of non-imaging, but rotation of the drum, the charge roll charges the drum to less than a Paschen breakdown voltage of the drum. A voltage of the transfer roll is determined that corresponds to a temperature and relative humidity of an operating environment of the imaging device and the developer roll is charged based thereon. The charge of the transfer roll is set close to the charge of the drum, but higher in magnitude. A laser may also discharge the drum. Embodiments include setting particular voltages and sequencing events, to name a few. Techniques apply to both color and monochromatic imaging devices having direct or indirect transfer to media.

DRAWINGS

The sole FIGURE is a diagrammatic view of an imaging device for reducing waste toner with EP voltage control.

DETAILED DESCRIPTION OF THE EMBODIMENTS

FIG. 1 teaches an imaging device 10 for reducing waste toner. The device is black only (shown) or color-imaging capable (not shown). The device receives at a controller, C, an imaging request 12 for imaging media 50. The controller typifies an ASIC(s), circuit(s), microprocessor(s), firmware, software, or the like. The request comes from external to the imaging device, such as from a computer, laptop, smart phone, cloud service, fax machine, etc. It can also come internally, such as from a copying request. In any, the controller converts the request to appropriate signals for providing to a laser scan unit 16. The unit turns on and off a laser 18 according to pixels of the imaging request. A rotating mirror 19 and associated lenses, reflectors, etc. (not shown) focus a laser beam 22 onto a photoconductive drum 30 rotating in the direction of arrow (A), as is familiar, or plural drums for color imaging (not shown). The drums correspond to supplies of toner, such as yellow (y), cyan (c), magenta (m) or black (k). A charge roll 32 sets a charge on a surface of the drum 30 as the drum rotates. The laser beam 22 electrostatically discharges the drum to create a latent image. A developer roll 34 introduces toner to the latent image and such is electrostatically attracted to create a toned image on a surface of the drum. A voltage differential between the surface of the drum 30 and an opposed transfer roll 36 transfers the toned image direct from the drum to a sheet of media 50 or indirect to an intermediate transfer member (not shown) for subsequent transfer to the media. The sheet advances from a tray 52 to a fuser assembly 56 to fix the toned image to the media through application of heat and pressure. Users pick up the media from a bin 60 after it advances out of the imaging device. The controller coordinates the operational conditions that facilitate the timing of the image transfer and transportation of the media from tray to output bin. The controller also coordinates with one or more high voltage power supplies 90 to set the relative voltages for the electrophotographic image process, including setting the voltages for the charge roll 32, the developer roll 34 and transfer roll 36.

To minimize the accumulation of waste toner from the drum scraped by a blade 35 into a reservoir 37, the controller implements an algorithmic routine of EP voltage control. The routine is triggered for execution at various times, but especially when the drum is rotating but the media is otherwise not undergoing imaging. In terms from the industry, the routine executes during "run-in" and "run-out" of an imaging request and/or at times when there exists an excessively large interpage gap. That is, "run-in" occurs when the controller begins preparing to honor the imaging request, but before the first page of the media of the imaging request becomes imaged with toner. Events undertaken by the controller at this time include signaling to motors to rotate the drums and rolls, to warm-up the fuser to fusing temperature, and to power the laser, to name a few. "Run-out," on the other hand, occurs after the last page of media of the imaging request has been imaged, but not yet exited the imaging device. The drum and rolls continue to rotate during this time. Excessively large interpage gaps exist during image duplexing of media sheets or when users operate the imaging device in narrow-media modes, such as when imaging envelopes. A size of the gaps are also measurable by the controller between a trailing edge (T.E) of one sheet of media 50 and a leading edge (L.E.) of an adjacent sheet of media. Operational conditions may be also considered when initiating the routine, such as accepting input from a local or remote weather station regarding the relative humidity and temperature of the environment in which the imaging device is operating. In situations where no weather station exists, as often occurs with more economical imaging devices typically embodied as monochromatic devices, the controller needs to make inferences to the operational conditions in which the imaging device operates.

From empirical testing, the inventors note that materials and composition of the transfer roll 36 exhibit a characteristic volume resistivity property that corresponds to different temperature and relative humidity conditions in which the imaging device operates. As such, taking measurements of a voltage of the transfer roll during dormant periods of the imaging device not influencing the temperature of the transfer roll, such as a 'cold start' of the imaging device, indicates weather conditions such as hot temperature and high relative humidity or cold temperature and dry humidity. Inference can be taken between those extremes also. To determine or infer the value of the voltage on the transfer roll, the controller senses the current $i_{sense}$ to the transfer roll 36 through the resistor R connected to ground. In one embodiment, the resistor resides in the HVPS. Once the $i_{sense}$ measurement reaches a preset current value, the voltage of the transfer roll is recorded. Such measurement typically can last for at least the time it takes to complete at least one full revolution of the transfer roll. In turn, the current is evaluated through signal processing techniques, such as averaged over time, or its mean determined, or other. Once measured, a correspondence is found to exist between the voltage ($i_{sense}$×R) of the transfer roll and the temperature/humidity. A further correspondence is found by the inventors to exist between the recorded voltage of the transfer roll and a voltage needed to be set on the developer roll to implement the routine of the instant embodiment to reduce waste toner accumulation. That is, the TABLE below shows the values of one composition of the transfer roll tested by the inventors. The values can be stored in local or remote memory (M) for access by the controller during use. Values between the twelve columns of the table can be also inferred such as by straight line approximation or other.

the charge roll to its core voltage. In this way, the voltage between the charge roll and the drum does reach its Paschen breakdown voltage and the coating of the drum is prevented from DC charging. In one embodiment, the Paschen breakdown voltage (which varies according to the air pressure and moisture content and a surface condition, like roughness or composition of the materials of the drum and charge roll, as is known) exists at about −570 Vdc, so the charge roll is set to about −550 Vdc. In turn, the drum only charges to its core voltage of about −300 Vdc, vice −700 Vdc during imaging. The transfer roll is also set to charge by the HVPS to a charge approximating that of the drum to largely prevent any charge exchange between the drum and transfer roll, but higher in magnitude. In this embodiment, the transfer roll is set to charge to about −500 Vdc. Then, based on the recorded cold start voltage of the transfer roll, the charge of the developer roll is set to that correspondence noted in the table. If the cold start transfer roll voltage was measured under relatively hot and wet humidity conditions, such as at −200 Vdc, then the developer roll voltage would be set to −45 Vdc (column 1, TABLE). Similarly, if colder and dryer, such as at −3000 Vdc, the developer roll would be set to charge at −140 Vdc (Column 10, TABLE). In most embodiments, however, the developer roll voltage is set to a value where stability occurs for the given composition of the developer roll, in this instance that being at least −40 Vdc. Of course, other voltage values are possible.

The controller also typically maintains these charges of the rolls, thereby holding the state of the drum, until the fuser and laser reach their steady state temperatures and power. Often, this lasts for a period of a few seconds or about two to three revolutions of the drum during run-in. The inventors have noted this results in a reduction of waste toner accumulation of about 50% compared to fully charging the drum during run-in. During run-out, on the other hand, the inventors have decided to set both the charge roll voltage and transfer roll voltage for a time period that corresponds to the time it takes for a surface of the drum to travel the distance from a nip formed with the charge roll to where the laser beam 22 impacts the surface of the drum, whereupon the controller causes the erasure of any existing charge on the drum by energizing the laser to discharge the drum. Thereafter, the developer roll voltage is set to its value obtained from the Table. After the last page of media of the

TABLE

| | ← Hotter/Wetter | | | | | | | | | Colder/Dryer → | | |
|---|---|---|---|---|---|---|---|---|---|---|---|---|
| | 1 | 2 | 3 | 4 | 5 | 6 | 7 | 8 | 9 | 10 | 11 | 12 |
| Transfer Roll Voltage (Vdc) | 200 | 400 | 600 | 800 | 1000 | 1200 | 1400 | 2000 | 2500 | 3000 | 4000 | 5000 |
| Developer Roll Voltage (Vdc) | −45 | −60 | −75 | −82 | −90 | −90 | −90 | −100 | −115 | −140 | −165 | −190 |

Further, the routine consists of lowering the charge on the drum when not imaging media during imaging requests, but at a time when the drum still rotates. In comparison to normal imaging conditions, for example, the charge roll is set to about −1200 Vdc to charge the drum to about −700 Vdc while the developer roll has its voltage set to about −600 Vdc. Under the routine to minimize accumulation of waste toner, however, the controller lowers the voltage on imaging request exits the nip of the fuser assembly, all EP voltages are turned off until a next imaging request.

The inventors further note through testing under lab conditions that about a 30% reduction in waste toner accumulation exists for all imaging requests of one-page compared to traditional techniques. Artisans should appreciate that the foregoing greatly overcomes designs of the prior art involving mechanical separation between developer units and drums and/or the use of AC power. Now the accumulation of waste toner can be minimized by a simple control routine that sets EP voltages.

The foregoing description of several methods and example embodiments has been presented for purposes of illustration. It is not intended to be exhaustive or to limit the claims. Modifications and variations to the description are possible in accordance with the foregoing. It is intended that the scope of the invention be defined by the claims.

The invention claimed is:

1. In an imaging device having a photoconductive drum charged by a charge roll and opposed by developer roll to add toner to the drum to develop a latent image on the drum for transfer to media or an intermediate transfer member at an opposed transfer roll, further including one or more high voltage power supplies in communication with a controller to set voltages on the charge roll, the developer roll and the transfer roll, a method comprising:

determining whether imaging of the media is to occur at a time when the drum is rotating;

if no imaging of the media is said to occur at the time when the drum is rotating, charging the photoconductive drum with the charge roll to less than a Paschen breakdown voltage of a surface potential of the photoconductive drum relative to a surface potential of the charge roll;

determining a current voltage of the transfer roll thereby the current voltage corresponding to a temperature and relative humidity of an operating environment of the imaging device; and based on the voltage of the transfer roll, setting a charge on the developer roll.

2. The method of claim 1, further including storing in memory a correspondence between the determined voltage of the transfer roll and the charge to be set on the developer roll.

3. The method of claim 1, further including determining a size of an interpage gap of an imaging request.

4. The method of claim 1, further including determining whether or not a first page of an imaging request has been imaged.

5. The method of claim 1, further including determining whether or not a last page of an imaging request has been imaged.

6. The method of claim 1, further including determining the current voltage of the transfer roll before imaging a first page of media of an imaging request.

7. The method of claim 1, further including discharging the drum with a laser beam.

8. In an imaging device having a photoconductive drum charged by a charge roll and opposed by developer roll to add toner to the drum to develop a latent image on the drum for transfer to media or an intermediate transfer member at an opposed transfer roll, further including one or more high voltage power supplies in communication with a controller to set voltages on the charge roll, the developer roll and the transfer roll, a method comprising:

receiving at the controller an imaging request, the request having a first page of media and a last page of media;

before imaging the first page of media, determining a current voltage of the transfer roll during a start of the imaging device thereby the current voltage corresponding to a temperature and relative humidity of an operating environment of the imaging device;

charging the drum with the charge roll to keep a drum potential less than a Paschen breakdown voltage relative to a potential of the charge roll;

setting a charge on the developer roll based on the determined current voltage of the transfer roll; and setting a charge on the transfer roll higher than the charge on the drum.

9. The method of claim 8, further including rotating the drum but imaging no media of the imaging request.

10. The method of claim 8, wherein the charging the drum occurs before imaging the first page of media and after imaging the last page of media.

11. The method of claim 8, wherein the setting the charge on the developer roll occurs before imaging the first page of media and after imaging the last page of media.

12. The method of claim 8, wherein the setting the charge on the transfer roll occurs before imaging the first page of media and after imaging the last page of media.

13. The method of claim 8, further including storing in memory a correspondence between the determined current voltage of the transfer roll and the charge to be set on the developer roll.

14. The method of claim 8, further including discharging the drum with a laser beam.

15. The method of claim 8, further including setting the charge on the transfer roll to −500 Vdc.

16. The method of claim 8, further including charging the drum to −300 Vdc.

17. The method of claim 8, further including setting the charge on the charge roll to −550 Vdc.

18. The method of claim 8, further including negatively charging the developer roll to at least −40 Vdc.

19. The method of claim 8, further including determining a size of an interpage gap of the imaging request.

20. The method of claim 8, further including determining a current supplied to the transfer roll.

* * * * *